US007469726B2

(12) United States Patent
Clüsserath et al.

(10) Patent No.: US 7,469,726 B2
(45) Date of Patent: Dec. 30, 2008

(54) BEVERAGE BOTTLING PLANT FOR FILLING BOTTLES WITH A LIQUID BEVERAGE, HAVING A FILLING MACHINE WITH A ROTARY CONSTRUCTION FOR FILLING BOTTLES WITH A LIQUID BEVERAGE

(75) Inventors: Ludwig Clüsserath, Bad Kreuznach (DE); Dieter-Rudolf Krulitsch, Bad Kreuznach (DE)

(73) Assignee: KHS Maschinen-Und Anlagenbau AG, Dortmund (DE)

( * ) Notice: Subject to any disclaimer, the term of this patent is extended or adjusted under 35 U.S.C. 154(b) by 591 days.

(21) Appl. No.: 11/102,548

(22) Filed: Apr. 8, 2005

(65) Prior Publication Data

US 2005/0241726 A1 Nov. 3, 2005

(30) Foreign Application Priority Data

Apr. 10, 2004 (DE) ..... 10 2004 017 205

(51) Int. Cl.
*B65B 31/00* (2006.01)

(52) U.S. Cl. ..... 141/57; 141/6; 141/144; 141/145; 141/146; 141/147

(58) Field of Classification Search ..... 141/4–8, 141/57, 144–147
See application file for complete search history.

(56) References Cited

U.S. PATENT DOCUMENTS 5,313,990 A * 5/1994 Clusserath ..... 141/6
7,353,848 B2 * 4/2008 Krulitsch ..... 141/56

FOREIGN PATENT DOCUMENTS

| | | | |
|---|---|---|---|
| DE | 3842578 | A1 | 6/1990 |
| DE | 20315253 | U1 | 2/2004 |
| EP | 0752388 | A1 | 1/1997 |
| EP | 1216952 | A2 | 6/2002 |

* cited by examiner

*Primary Examiner*—Timothy L Maust
(74) *Attorney, Agent, or Firm*—Nils H. Ljungman & Associates

(57) ABSTRACT

A container filling machine for filling containers, such as bottles, with a liquid, such as a beverage, has at least one filling element for dispensing liquid. The filling element has a gas passage to control the flow of gas there through for filling containers under different pressures or no pressure.

20 Claims, 9 Drawing Sheets

| Filling machine with | Filling method | Liquid or beverage bottled |
|---|---|---|
| | | |
| Filling elements 1 | 1-chamber filling | Soft drinks (cola, soda etc.), sparkling mineral water |
| Filling elements 1a Variant 1 | 1-chamber filling | Soft drinks (cola, soda etc.), sparkling mineral water |
| | Pressureless filling | Still water, fruit juice beverages that contain preservatives |
| Filling elements 1a Variant 2 | 1-chamber filling | Soft drinks (cola, soda etc.), sparkling mineral water |
| | 3-chamber pressure filling (including inert gas pressurization) | Oxygen-sensitive beverages with low levels of CO2 (e.g. spritzers, sports and wellness drinks, beverages with Vitamin C) |
| Filling elements 1b | 1-chamber filling | Soft drinks (cola, soda etc.), sparkling mineral water |
| | 3-chamber pressure filling (including inert gas pressurization) | Fruit spritzers with low levels of CO2, microbiologically sensitive and O2-sensitive fruit juice beverages, sports and wellness drinks with low levels of CO2. |
| | Pressureless filling | Fruit juices and fruit juice drinks, iced tea, sports and wellness drinks without CO2 |

FIG. 1B

BEVERAGE BOTTLING PLANT FOR FILLING BOTTLES WITH A LIQUID BEVERAGE, HAVING A FILLING MACHINE WITH A ROTARY CONSTRUCTION FOR FILLING BOTTLES WITH A LIQUID BEVERAGE

BACKGROUND

1. Technical Field

The present application relates to a beverage bottling plant for filling bottles with a liquid beverage, having a filling machine with a rotary construction for filling bottles or similar containers with a liquid beverage.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

OBJECT OR OBJECTS

Filling machines of this type are known in numerous models. The object is to describe a filling machine which, with a simplified and still reliable realization of the filling machine and of the filling elements, makes possible a filling under pressure as well as at least basically also a pressureless filling. The present application teaches that this object can be accomplished by a filling machine as described herein.

SUMMARY

The embodiments and models comprise a bowl that is provided on the rotor of the filling machine is realized so that when the machine is ready for operation, said bowl is filled only partly with the liquid to be bottled, and the interior of this bowl is therefore formed by a liquid space that is filled with the liquid being bottled, and above that a gas headspace. Further, in the respective element of the embodiments, in addition to a choked or throttled, uncontrolled gas path that connects the return gas tube of each filling element with a collecting duct that functions for all the filling elements in common or for respective groups of filling elements and as a return gas duct, a first, controlled gas duct is provided, by means of which the gas headspace of the bowl can be placed in controlled communication with the return gas tube and/or with a duct realized in said return gas tube. Even with this simplified realization, a pressure filling (single-chamber pressure filling) and basically a pressureless filling are optionally possible.

In an additional embodiment, in each filling element, in addition to the uncontrolled gas path and to the first controlled gas path, a second controlled gas path that has a choke (throttle?) is provided, which is functionally parallel to the choke of the uncontrolled gas path. With this embodiment, simply by actuating the gas path control valves and without an exchange or replacement of chokes or nozzles, at least three selectable filling variants are possible, and specifically a single-chamber pressure filling or pressureless filling or a single-chamber pressure filling or 3-chamber pressure filling (including pre-pressurization with inert gas).

Simply by the appropriate actuation of the respective liquid valve and of the gas path control valves that control the gas paths, the filling method can be optimally adapted to the specific requirements of the liquid being bottled, so that with a simplified realization of the filling machine and of the filling elements a broad spectrum of liquids can be bottled, in particular including a broad spectrum of beverages.

In an additional possible realization, each filling element has, in addition to the choked, uncontrolled gas path and the first and second controlled gas path, an additional third controlled and choked gas path, i.e. a gas path provided with a choke, which is then arranged functionally parallel to the choke of the second controlled gas path. The gas path control valve of this third controlled gas path is constantly closed during a pressure filling, and is constantly open during a pressureless filling, so that the gas path control valves of this third controlled gas path of all the filling elements of the machine can be actuated by means of a single, common control line and/or by means of a single, common control element, as a result of which, in spite of a number of different filling methods, a very much simplified and lower-cost realization of the overall machine is possible.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments are disclosed in the subclaims. The present application is explained in greater detail below with reference to the exemplary embodiments that are illustrated in the accompanying figures, in which:

FIG. 1B is a table showing individual filling methods and their preferred applications;

DESCRIPTION OF EMBODIMENT OR EMBODIMENTS

Figure 1:
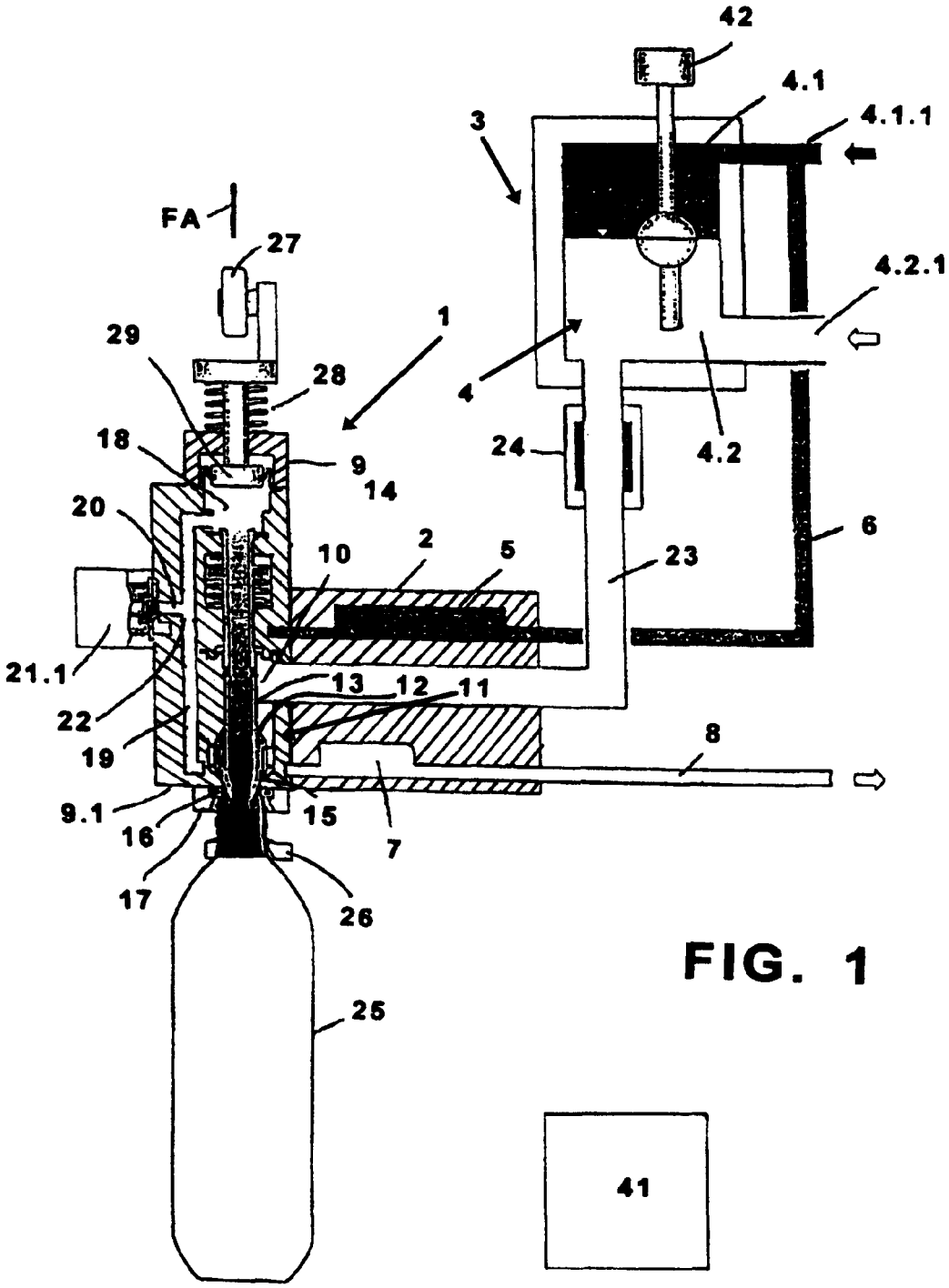
FIG. 1 is a schematic view of one of the filling elements of a filling element of a filling machine with a rotary construction for bottling a liquid in containers or bottles, together with a rotor of the filling machine and a bowl for the liquid to be bottled that is provided on the rotor.
Figure 1A:
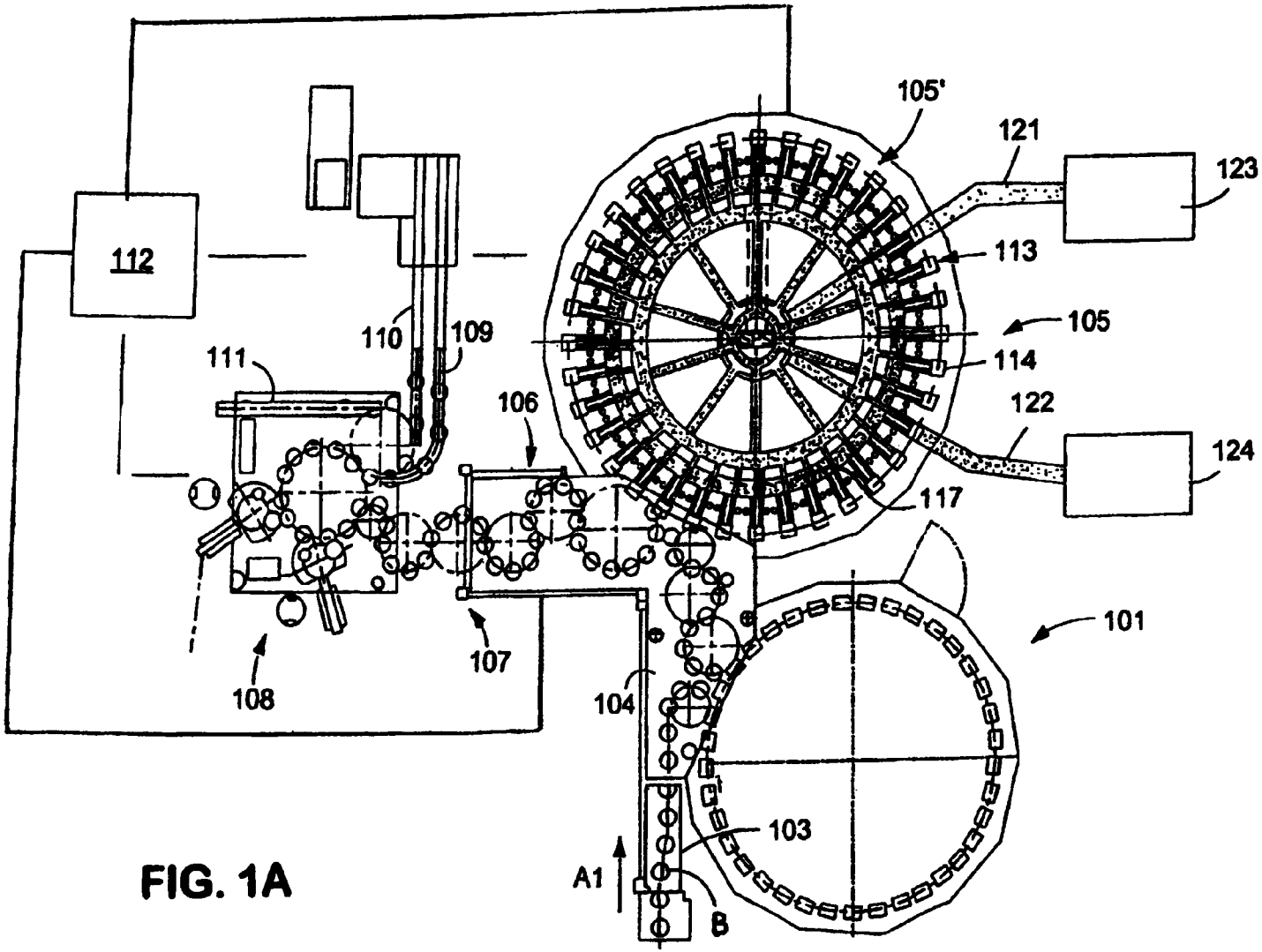
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

FIG. 1 shows a filling element 1 which is located along with a plurality of identical filling elements on the periphery of a rotor 2 that can be driven around a vertical machine axis. Also provided on the rotor 2 is a bowl 3, for example a ring bowl, the bowl interior 4 of which is filled partly with the liquid to be bottled, i.e. up to a level N, so that in the interior of the bowl 4 a gas headspace 4.1 is formed, and below that a liquid space 4.2 are formed. During the filling process, the gas headspace 4.1 is pressurized with the pressure of an inert gas, for example $CO_2$ gas, which is fed in via the connection 4.1.1. The liquid being bottled is fed to the liquid space 4.2 from a reservoir via the connection 4.2.1.

In the rotor 2 there is a common distribution or ring duct 5 formed which concentrically surrounds the vertical machine axis and is common to all the filling elements 1 of the filling machine, and is in communication via a connection 6 with the gas space 4.1 or with the connection 4.1.1 of the gas space. In the rotor 2 there is an additional collecting or ring duct 7 which concentrically encircles the vertical machine axis and is common for all the filling elements, which is vented via a line 8 to the atmosphere, for example, and is in communication with a device for the purification or recovery of inert gas.

The filling element 1 comprises essentially the filling element housing 9, in which the liquid duct 10 with the liquid valve 11 is realized. The latter comprises the valve body 12 that interacts with a valve seat in the liquid duct 10 on a return gas tube 13 that is oriented equi-axially with the filling element axis FA, which return gas tube 13 can be moved by an actuator device 14 to open and close the liquid valve 11 by a specified distance toward the axis FA. In the illustrated embodiment, the actuator device 14 comprises essentially a restoring spring which applies a bias to hold the liquid valve 11 into the open position, and a pneumatic cylinder with which the return gas tube 13 and the valve body 12 are moved into the closed position and held there.

On the underside 9.1, the liquid duct 9 forms a ring-shaped dispensing opening 15, which is surrounded by a ring-shaped gasket 16 and a centering element 17. The lower, open end of the return gas-tube 13 is located in the vicinity of the dispensing opening 15. With its upper, open end, the return gas tube 13 empties into a chamber 18 that is realized in the housing 9, which chamber 18 is in communication via an uncontrolled gas duct 19 realized in the housing 9 with the ring duct 7 that is common to all the filling elements 1.

In the housing 9, a first controlled gas duct 20 is realized, which extends between the ring duct 5 that is common to all of the filling elements 1 and the gas duct 19 that is realized in the filling element 1, and in which a first, pneumatically controllable gas path control valve 21.1 (gas cylinder) is provided.

In the gas duct 19 there is a nozzle or choke 22 which has a specified flow cross section and is located at the point where the gas duct 20 empties into the gas duct 19, and namely on a segment of the gas duct 19 that leads from this point to the ring duct 7.

The liquid duct 10 is connected on its end farther from the dispensing opening 15 with a line 23 that is provided individually for each filling element with the liquid space 4.2. A sensor 24 that measures the flow is provided in this line 24 for the volumetric control of the filling process.

The respective bottle 25 to be filled is held during the filling process on a container or bottle holder 26, which in the illustrated embodiment holds the respective bottle 25 from behind by means of a radially projecting flange that is formed on the bottle neck below the bottle mouth. The bottle carrier can be moved by a specified distance along the axis FA to raise and lower the bottle 25, and in particular to press the bottle 25 with the edge of its mouth against the gasket 16, and in particular controlled by a control roller 27 that is connected by means of a lifting rod (not shown) and interacts with a control cam that does not rotate with the rotor 2. By means of a compression spring 28 and by means of a pressure exerted on the piston 29, in the chamber 18 the container carrier 26 is biased upward for the movement, so that for a pressure filling there is a "self-clamping" effect.

With the filling system illustrated in FIG. 1, a single-chamber pressure filling is possible, among other things, and specifically with the following process steps, whereby the single gas path control valve 21.1 is generally in the closed position, unless the open position is explicitly indicated in the following description:

Insertion and Lifting of the Respective Bottle

At the beginning of the filling process, the respective bottle 25 is inserted into the lowered bottle carrier 26 at a bottle inlet, and is then lifted by the force of the spring 28.

Pressurization or Tempering of the Bottle

Then the bottle 25 is pressurized with the inert gas under pressure from the gas headspace 4.1 or the ring duct 5. For this purpose, the gas path control valve 21.1 is opened, so that the pressurization gas can flow into the bottle 25 via the opened gas duct 20, the chamber 18 and the return gas tube 13. As a result of the pressure that accumulates in the chamber 18, there is an additional automatic pressing of the bottle 25 with the edge of its mouth against the gasket 16.

The choke 22 is selected so that only a relatively small amount of inert gas flows through the ring duct 7.

Rapid Filling

With the valve 21.1 remaining open, the liquid valve 11 is also opened, so that the liquid being bottled flows via the dispensing opening 15 into the bottle 25, which is still in sealed contact with the filling element 1, and the gas that is thereby displaced from the bottle flows back via the return gas tube 13 and then the majority of the gas flows via the opened gas duct 20 and the ring duct 5 into the gas headspace 4.1, while a small fraction of the displaced gas is also diverted via the choke 22 and the ring duct 7.

Low-Speed Filling

With the liquid valve 10 remaining open, the gas path control valve 20.1 is closed, so that the gas that is displaced from the bottle 25 can now flow out simply via the choke 22 and the ring duct 7.

End of the Filling Process

As soon as the specified quantity of liquid, monitored by the sensor 24, has been dispensed into the bottle 25, the liquid valve is also closed.

Preliminary Depressurization and Calming

After the closing of the liquid valve 11, the interior of the bottle 25 is depressurized by means of the gas duct 19 and the choke 22 into the ring duct 7, so that after the depressurization, the bottle carrier 26 can be lowered onto the bottle outlet by the control cam that interacts with the roller 27 and the filled bottle 25 can be removed.

This single-chamber pressure filling process is appropriate in particular for soft drinks and mineral waters that contain $CO_2$.

Figure 2:
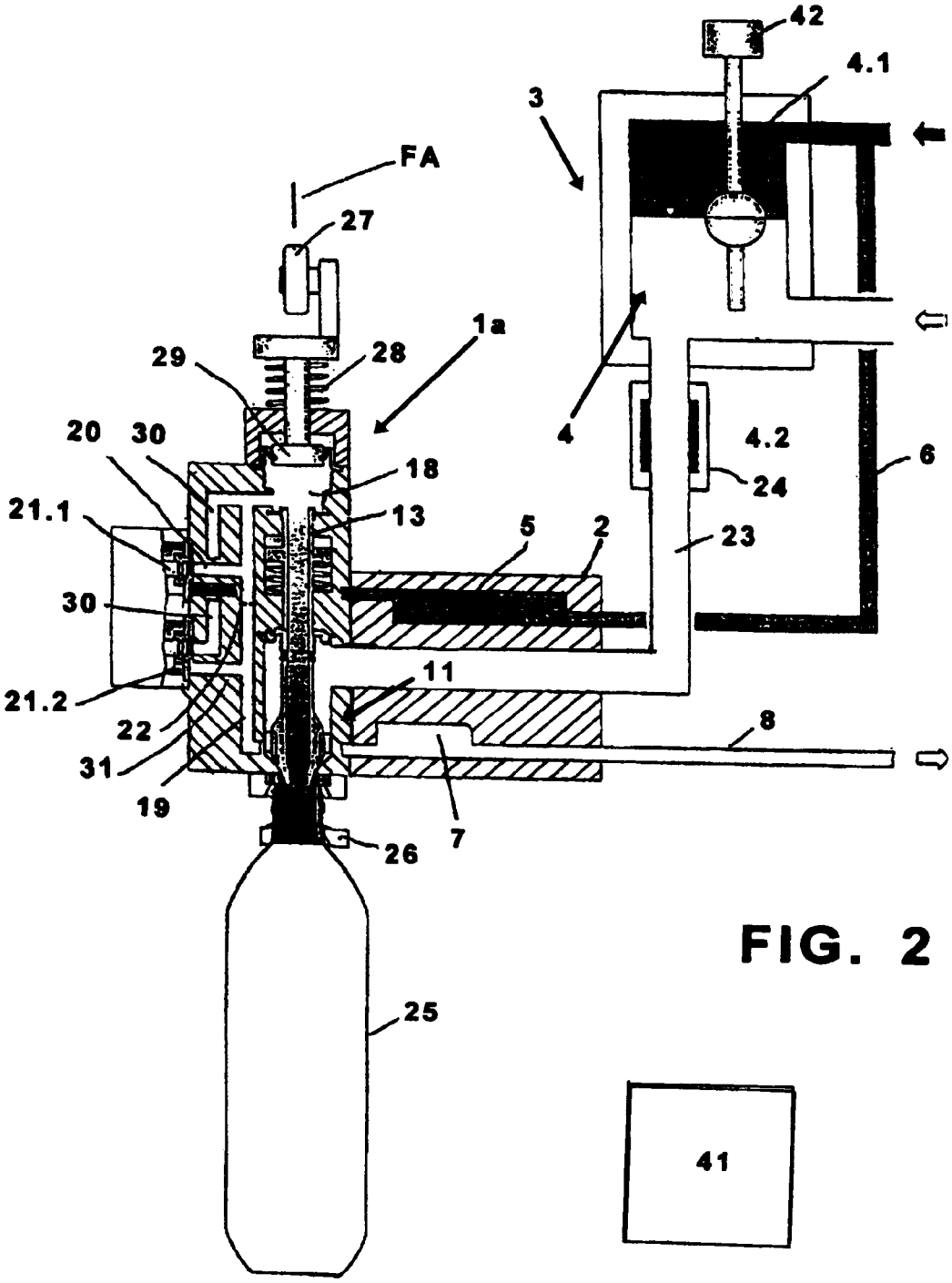
FIGS. 2-5 are illustrations as in FIG. 1, but of variant realizations of the filling element.

FIG. 2 shows an additional possible embodiment of a filling element 1*a*, which differs from the filling element 1 essentially only in that in the housing 9, in addition to the gas ducts 19 and 20, a second controlled gas duct 30 is provided, which runs between the chamber 18 and the gas duct 19 and in which there is a second gas path control valve 21.2 in series with a choke 31. The gas duct 30 empties into the gas duct 19 in a portion of said gas duct 19 between the choke 22 and the ring duct 7, and is thereby functionally parallel to the choke 22.

With the filling element 1*a*, the single-chamber pressurized filling described above is possible, in which only the gas path control valve 21.1 is controlled, and specifically in the manner described above for the single-chamber pressure filling process in connection with the filling element 1.

A pressureless filling can also be performed with the filling element 1*a*. This pressureless filling process, which is suitable for, among other things, the bottling of still water and fruit juice beverages that contain preservatives and in which the gas path control valve 21.2 is constantly open and the gas headspace 4.1 is at atmospheric pressure or approximately atmospheric pressure, includes the following process steps.

Insertion and Raising of the Individual Bottles

At the bottle inlet, the individual bottles 25 are again inserted and lifted into a sealed position against the filling element 1*a*.

High-Speed Filling

With the gas path control valves 21.1 and 21.2 open, the liquid valve 11 is opened, so that the liquid flows into the bottle 25 via the dispensing opening 15 and the air that is thereby displaced from the bottle 25 can flow out via the open gas duct 20 and the likewise open gas duct 30, and specifically both via the ring duct 5 into the connection 4.1.1 and into the ring duct 7 and via the line 8 to the atmosphere.

Low-Speed Filling

For the low-speed filling, the gas path control valve 21.1 is closed, so that with the gas duct 30 still open, the displaced air flows through the chokes 22 and 31 and brings about a decelerated filling.

End of the Filling Process

Controlled by the signal from the sensor 24, and with the gas path control valve 21.2 still open and the gas path control valve 21.1 closed, the liquid valve 11 is closed, and the filled bottle is lowered.

In the filling processes described above (single-chamber pressure filling or pressureless filling), the gas path control valves 21.2 of all the filling elements 1*a* can be placed in communication with a common ring line and control line, and can be actuated via this common control line, and specifically into the closed position for the single-chamber pressurized filling and into the open position for pressureless filling, so that the filling machine can not only be switched from one process to the other easily by controlling the gas path control valves 21.1 and 21.2 in a manner that is not described in any further detail, but also so that only one single control line and/or one single control element is necessary for the gas path control valves 21.2 of all the filling elements 1*a*.

With the filling element 1*a*, it is also possible simply by controlling the gas path control valves 21.1 and 21.2 to switch between single-chamber pressurized filling or 3-chamber pressurized filling. The three-chamber pressure filling, in which the gas headspace 4.1 again contains the inert gas under pressure, then includes the following process steps:

Insertion and Lifting of the Bottles

On the bottle inlet, the individual bottle is again raised with the bottle carrier 26 and is placed with the mouth of the bottle in sealed contact against the filling element.

Pressurization

The bottle 25 is pressurized and is additionally pressed against the filling element by opening the gas path control valve 21.1.

High-Speed Filling

After the closing of the gas path control valve 21.1 and the opening of the gas path control valve 21.2, the liquid valve 11 is opened, so that the liquid being bottled flows into the bottle 25 via the dispensing opening 15 and the gas that is displaced from the bottle flows via the return gas tube 13 and the opened gas duct 30, and via the choke 22 provided in the gas duct 19 to the ring duct 7, and is removed from there via the line 8.

Low-Speed Filling

With the liquid valve 11 still open, the gas path control valve 21.2 is closed, so that the gas that is displaced from the bottle 25 can now flow only via the gas duct 19 and the choke 22 into the ring duct 7.

End of the Filling Process

With the gas path control valves 21.1 and 21.2 still closed, the liquid valve is closed in response to a signal from the sensor 24, so that via the gas duct 19 and the choke 22 in it, the pressure can be reduced and the liquid can be calmed, and after the preliminary snifting, or escape of gas, the filled bottle 25 with the bottle carrier 26 can be lowered.

The 3-chamber pressure filling with the filling elements 1*a* is suitable for, among other things, oxygen-sensitive beverages that contain a low proportion of $CO_2$, such as fruit spritzers, sports drinks, health drinks and beverages that contain Vitamin C.

Figure 3:
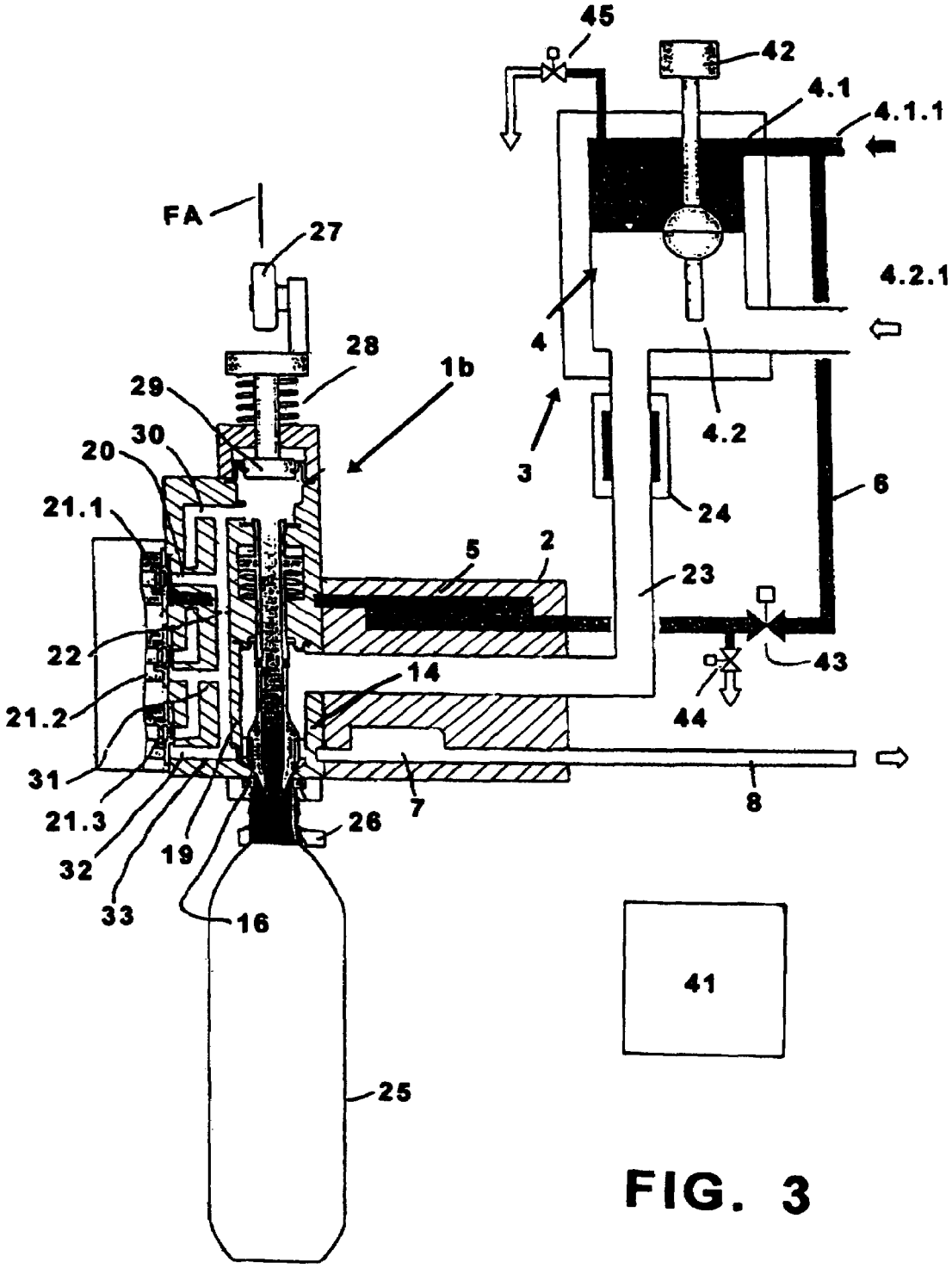

FIG. 3 shows, as an additional possible realization, a filling element 1*b* which differs from the filling element 1*a* in that in the filling element housing 9, there is a third controlled gas duct 32, which extends between the section of the gas duct 19 that is directly connected with the ring duct 7 and the section of the gas duct 30 that lies between the gas path control valve 21.2 and the gas duct 19 and empties into this section of the gas duct 30 between the gas path control valve 21.2 and the choke 31, so that the third controllable gas duct 32 is functionally parallel to the choke 31. In the gas duct 32, there is a third gas path control valve 21.3 in series with a choke 33.

With the filling element 1*b*, all the above mentioned filling methods, i.e. single-chamber pressure filling, pressureless filling and 3-chamber pressure filling can be performed in the manner described above, and in particular without replacing nozzles or chokes, and simply by an appropriate control of the liquid valve 11 and of the gas path control valves 21.1 and 21.2. The gas path control valves 21.3 of all the filling elements 1*b* can in turn be actuated by means of a common control line, i.e. with pneumatically actuated valves 21.3 by means of a common pneumatic control line which is actuated by a single solenoid valve. For single-chamber pressure filling and the 3-chamber pressure filling, the valves 21.3 are constantly closed, and for pressureless filling they are constantly open.

Especially for pressureless filling, during the insertion and raising of the bottle 25, the gas path control valves 21.1 and 21.1 are closed and the gas path control valve 21.3 is opened. The gas path control valves 21.1, 21.2 and 21.3 of the filling elements 1*b* are then controlled so that during the high-speed filling, all three gas path control valves are open, during low-speed filling only the two gas path control valves 21.2 and 21.3 are open, and at the end of the filling and during the lowering of the bottle, again only the gas path control valve 21.3 is open.

The 3-chamber pressure filling with the filling elements 1*b* is suitable for, among other things, fruit spritzers with a low $CO_2$ content, for microbiologically sensitive and oxygen-sensitive beverages, in particular fruit juice beverages, for sports drinks and health drinks with a low $CO_2$ content.

The pressureless filling with the filling elements 1*b* is suitable for, among other things, fruit juices and fruit juice beverages, iced tea, sports drinks and health beverages that are not carbonated.

The individual filling methods and their preferred applications are summarized in the table shown in FIG. 1B.

When the filling elements 1*a* are used, depending on the filling system or filling variant (Variant 1 or Variant 2) required, only nozzles or chokes 22, 31 and/or 33 with different sizes are used, i.e. by replacing the nozzles it is also possible to convert the filling machine from Variant 1, in which it is possible to switch from the single-chamber pressure filling to pressureless filling simply by activating the gas path control valves 21.1 and 21.2, to Variant 2, in which it is possible to switch from the single-chamber pressure filling to 3-chamber pressure filling simply by actuating the gas path control valves 21.1 and 21.2.

Figure 4:
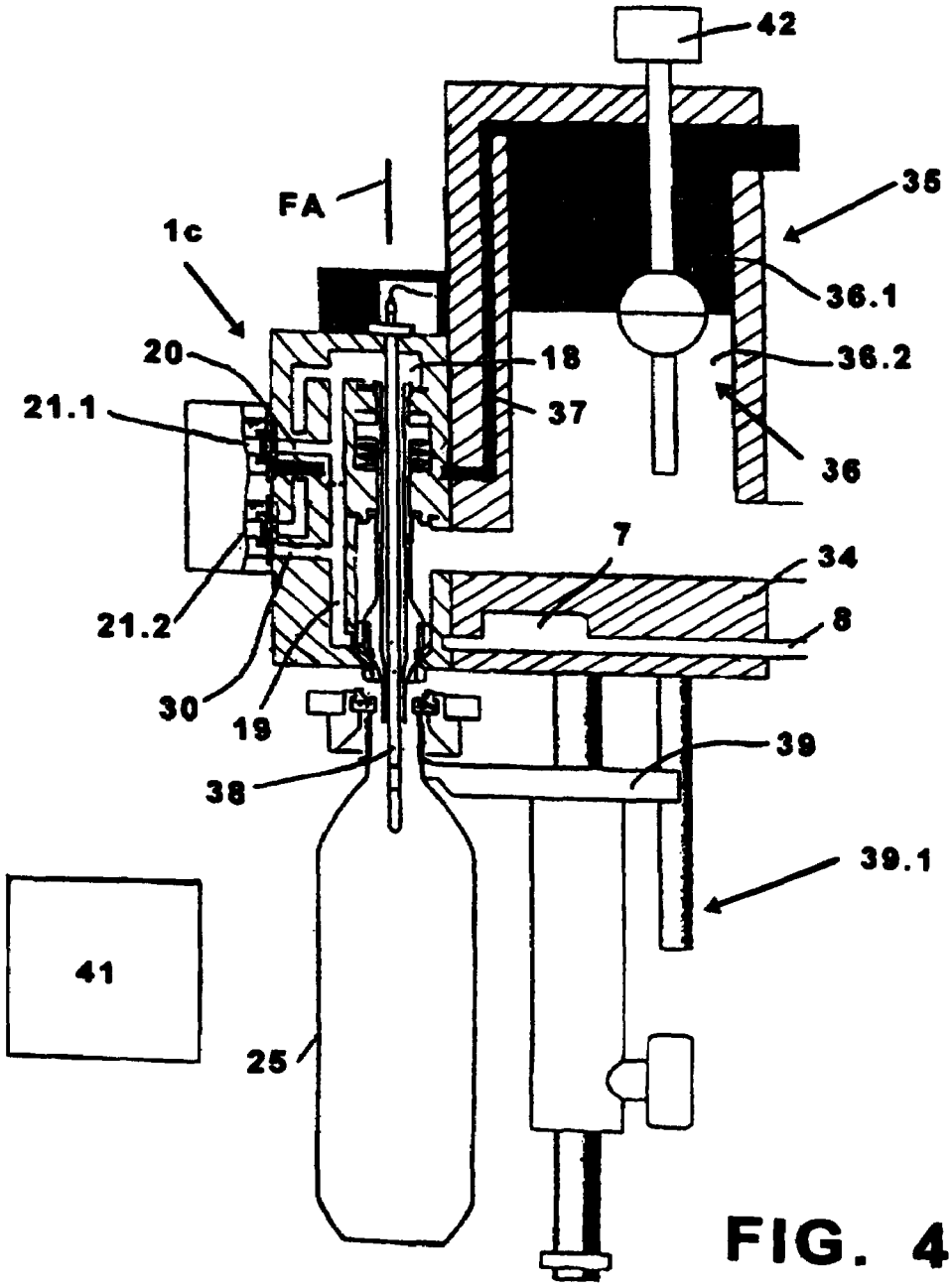

FIG. 4 shows, as an additional possible realization, a filling element 1*c* as well as portions of the rotor 34 with a filling machine that has a rotary construction with a bowl 35 (such as a ring bowl, for example) provided on the rotor 34 with the bowl interior 36 partly filled with the liquid being bottled and the upper gas headspace 36.1 and lower liquid space 36.2 thereby formed, which correspond to the gas space 4.1 and liquid space 4.2 respectively in FIGS. 1-3. By means of the connection 37 that corresponds to the connection 6, each filling element 1*c* or the gas duct 20 realized in each filling element is in direct communication with the gas space 36.1. The filling elements 1*c* correspond in terms of their realization, as well as in particular in terms of the realization and control of the gas paths, i.e. of the gas path control valves 21.1 and 21.2 as well as in terms of the control of the liquid valve 11, to the filling elements 1*a* in FIG. 2.

The filling element 1*c* differs from the filling element 1*a* in that instead of the volume-controlled filling, the filling is controlled as a function of the level of the liquid, and for this purpose each filling element 1*c* of the filling machine has a probe 38 that determines the filling level and during the filling process extends with its probe tip into the respective bottle 25. An additional difference is that instead of the bottle carrier 26, on each filling element a bottle carrier 39 is provided which is controlled by a lifting device 39.1, which in turn holds the respective bottle 25 from behind by means of the projecting flange that is realized on the neck of the bottle.

With the filling elements 1*c*, by controlling the liquid valve 11 and the two gas path control valves 21.1 and 21.2, the same filling methods are possible as were described above for the filling machine that has the filling elements 1*a*, with the only difference that the end of the respective filling process is initiated by a signal from the probe 38.

Figure 5:
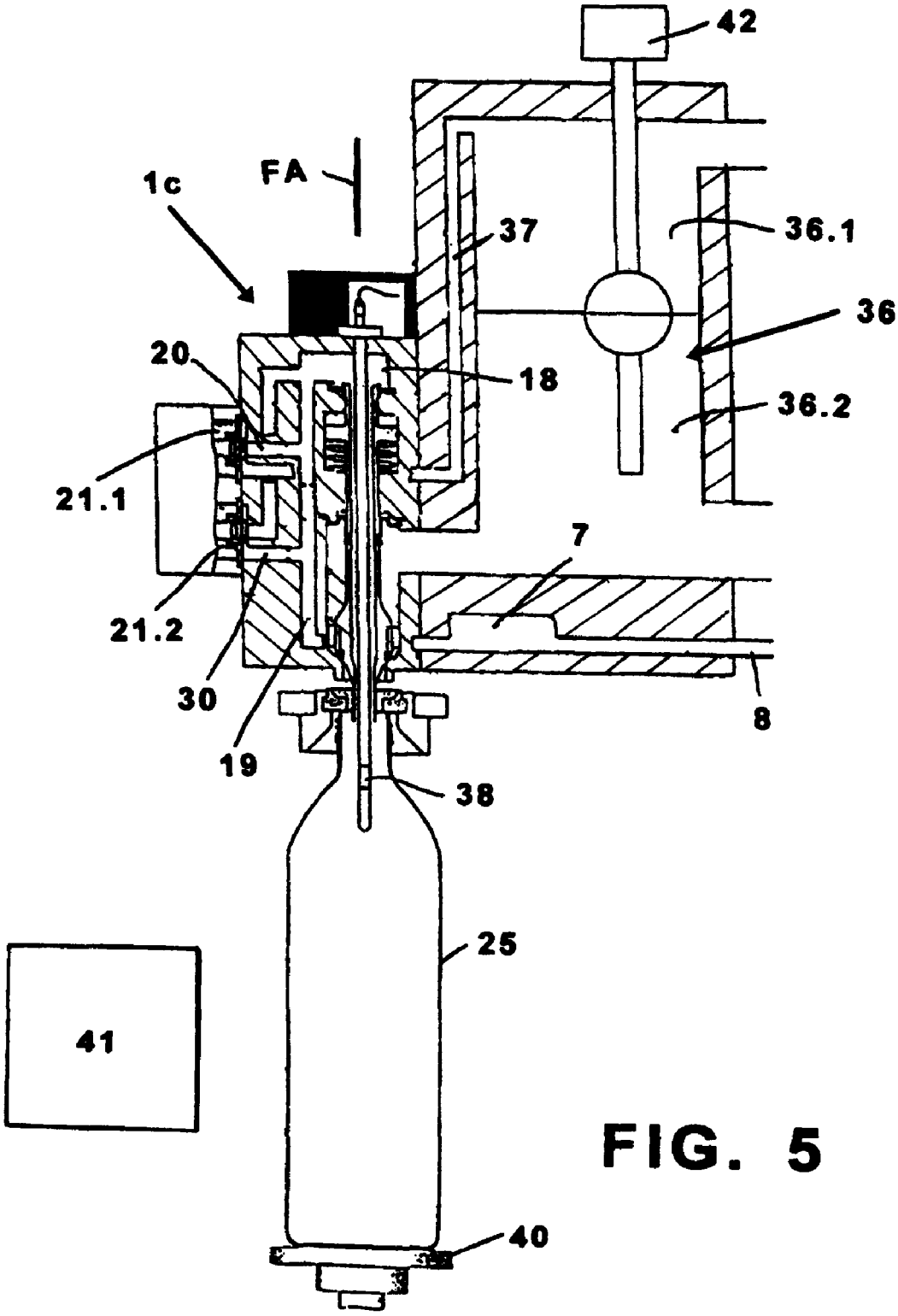

As shown in FIG. 5, the filling machine in FIG. 4 can also be realized so that instead of the bottle carrier 39, a bottle carrier 40 is provided, on which the respective bottle 25 stands on its base, and which is controlled by a lifting device (not shown) to raise and lower the respective bottle 25.

Figure 4A:
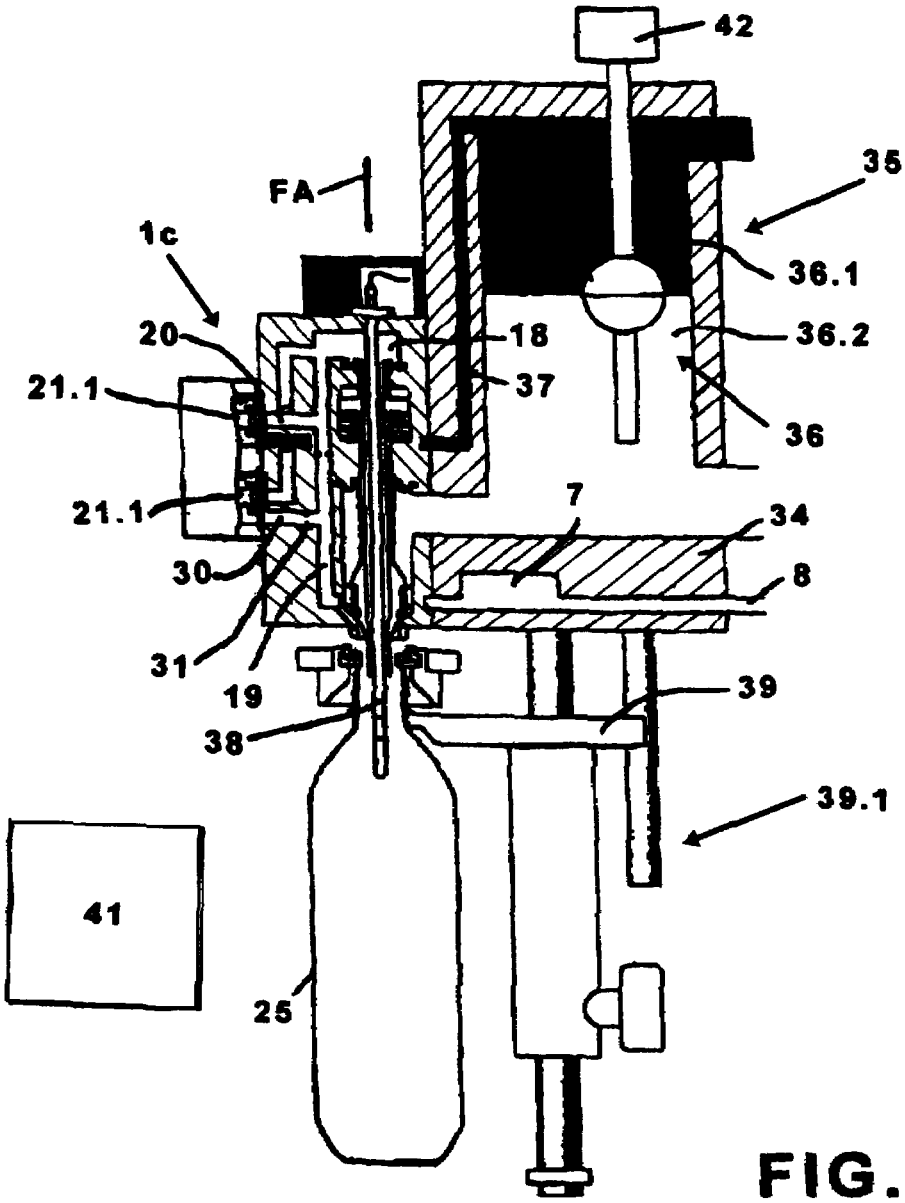
FIG. 4A shows further detail of the possible embodiment shown in FIG. 4.
Figure 5A:
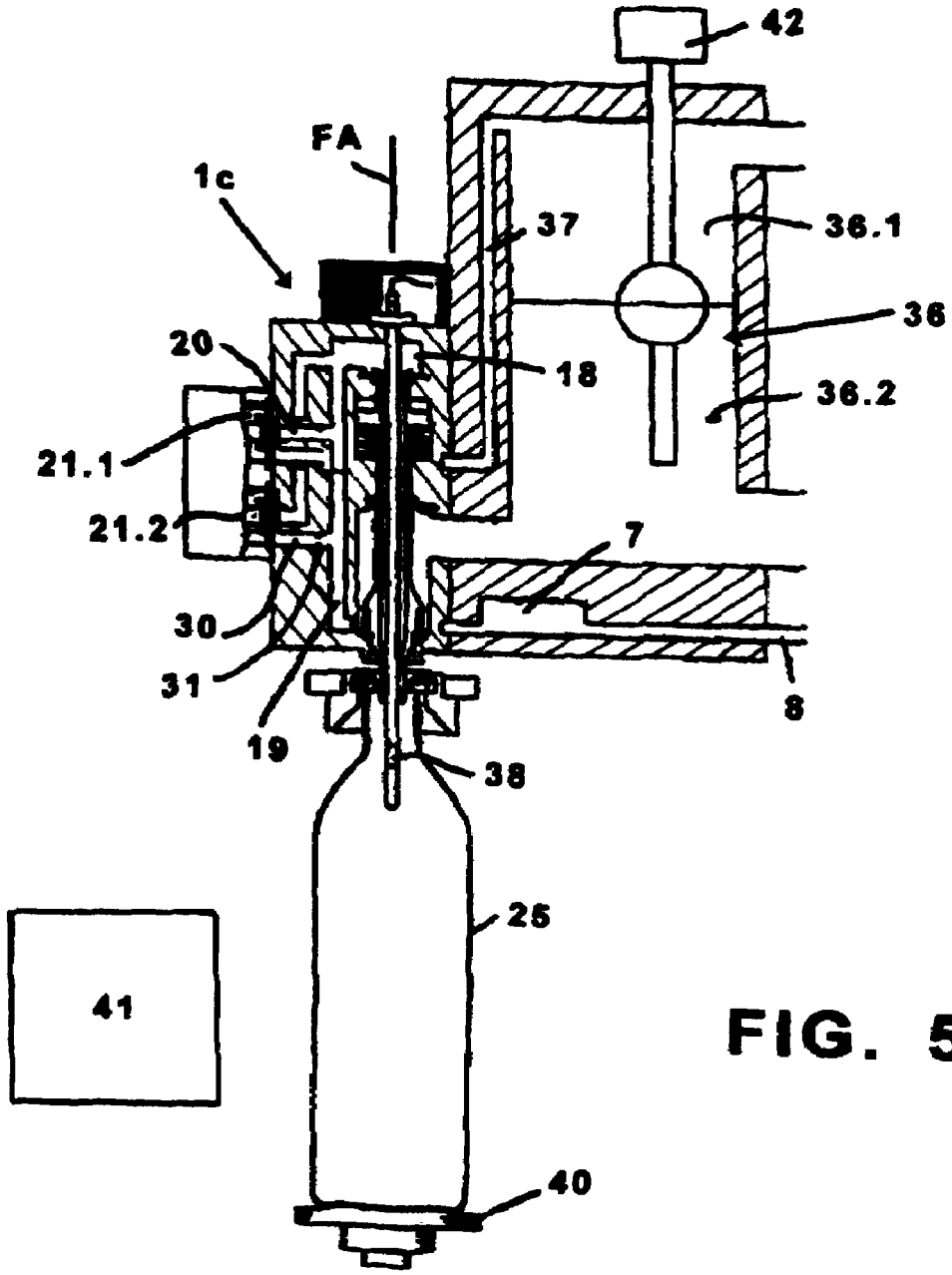
FIG. 5A shows further detail of the possible embodiment shown in FIG. 5.

FIG. 4A shows further detail of the possible embodiment shown in FIG. 4. FIG. 5A shows further detail of the possible embodiment shown in FIG. 5.

In all the embodiments described above, the liquid valve 11 and the respective gas path control valves 21.1, 21.2 and 21.3 are controlled by a central control device 41 (computer) of the filling machine. In the illustrated embodiment, the gas path control valves 21.1, 21.2 and 21.3 are pneumatically actuated valves which are then actuated in the required manner by the control device 41 by means of electrically controlled pneumatic valves (not shown) and pneumatic control lines (also not shown).

In the above embodiments, the respective bowl 3 or 35 is only partly filled with the liquid to be bottled, so that in said bowl the gas space 4.1 or 36.1 and the liquid space 4.2 or 36.2 are formed. The level N of the surface of the liquid in the interior of the bowl is regulated by a level control 42.

In the embodiment illustrated in FIG. 3, in the connection 6 between the gas headspace 4.1 and the collecting or ring duct 5 there are also electrically controllable valves 43 and 44 as well as an additional electrically controlled valve 45 on an additional connection of the gas space 4.1, and in particular for the control of the flow path of a cleaning fluid that is used for a CIP cleaning of the filling machine.

In at least one possible embodiment, the filling machine could comprise a gas return tube 13, which gas return tube 13 leads from the dispensing opening 15 to the chamber 18 and is configured to permit the flow of gas from a bottle being filled. A gas duct 19 could run substantially parallel to the gas return tube 13, and could be configured and disposed to carry gas from the chamber 18. The filling machine may further comprise a gas path 20, which gas path 20 extends between the ring duct 5 that is common to all of the filling elements 1 and the gas duct 19. The gas duct 19 could comprise a choke 22, which could be located at the point where the gas path 20 empties into the gas duct 19, and namely on a segment of the gas duct 19 that leads from the choke 22 to the ring duct 7. The choke 22 could have a smaller cross section than the gas duct 19 and the gas path 20 so that it permits gas to flow through the choke 22 in order to slow the filling process.

The single-chamber filling process for the above possible embodiment is described herein above. Near the end of the filling process, the gas path control valve 21.1 is closed so that gas now only flows through the gas duct 19 and the choke 22, to escape through the ring duct 7. The gas flowing through the gas path 20 flows much faster than the gas flowing through the gas duct 19 and the choke 22. The filling process is slowed to substantially prevent or minimize overfilling or underfilling of the bottle, and in the case of carbonated beverages, to substantially prevent or minimize the bubbling over or overflow of foam. Once the bottle is filled, any remaining gas exits through the gas duct 19, the choke 22, and then out the ring duct 7.

In other possible embodiments, the filling element could comprise a plurality of other gas ducts, gas paths, chokes, and gas flow control valves as described herein above. The purpose of other gas ducts, gas paths, and gas flow control valves is to make possible filling of different types of beverages, such as soft drinks, including cola, soda, etc., sparkling mineral water, still water, fruit juice beverages that contain preservatives, oxygen-sensitive beverages with low levels of $CO_2$, including spritzers, sports and health drinks, beverages with Vitamin C, fruit spritzers with low levels of $CO_2$, microbiologically sensitive and O2-sensitive fruit juice beverages, sports and health drinks with low levels of $CO_2$, fruit juices and fruit juice drinks, iced tea, sports and health drinks without $CO_2$, which require different methods of filling, such as single-chamber pressure filling, pressureless filling and 3-chamber pressure filling, with the same filling element. The different filling methods could be utilized within the same filling element without replacing nozzles or chokes, and simply by an appropriate control of the above described liquid valve 11 and of the gas path control valves 21.1, 21.2, and 21.3 as described herein above.

FIG. 2 shows another possible embodiment that could be used for single-chamber filling or pressureless filling. In this possible embodiment, the gas path control valve 21.2 remains open throughout the filling process. After the fast-filling process, the gas path control valve 21.1 is closed so that gas flows out of the gas return tube 13 via the gas path 30, and out through the gas path control valve 21.2 and its respective choke 31, and also through the uncontrolled gas duct 19 and its respective choke 22. Pressureless filling is used for beverages such as still water and fruit juice beverages that contain preservatives. Filling is decelerated in order to calm the beverage flow and in order to substantially prevent or minimize overfilling or underfilling of a bottle.

The 3-chamber pressure filling with the filling elements 1*b* is suitable for, among other things, fruit spritzers with a low $CO_2$ content, for microbiologically sensitive and oxygen-sensitive beverages, in particular fruit juice beverages, for sports drinks and health drinks with a low $CO_2$ content. During the 3-chamber filling process, the gas path control valve 21.1 is opened in order to pressurize the bottle to be filled. Once the bottle is pressurized, the gas path control valve 21.1 is closed, and the gas path control valve 21.2 is opened for the fast-filling of the bottle. Then the gas path control valve 21.2 is closed during the slow-filling of a bottle, and gas from the bottle escapes through the uncontrolled gas path 19 and the choke 22.

FIG. 3 shows another possible embodiment that could be used for single-chamber pressure filling, pressureless filling, and 3-chamber filling. During single-chamber pressure filling and the 3-chamber pressure filling, the valves 21.3 are constantly closed, and for pressureless filling they are constantly open. Especially for pressureless filling, during the insertion and raising of the bottle 25, the gas path control valves 21.1 and 21.1 are closed and the gas path control valve 21.3 is opened. The gas path control valves 21.1, 21.2 and 21.3 of the filling elements 1*b* are then controlled so that during the high-speed filling, all three gas path control valves are open, during low-speed filling only the two gas path control valves 21.2 and 21.3 are open, and at the end of the filling and during the lowering of the bottle, again only the gas path control valve 21.3 is open.

In another possible embodiment, the gas path control valves 21.1, 21.2, and 21.3 in the embodiment shown in FIG. 3 could be used in a sequence in order to remove gas from a bottle being filled. For instance, the filling process could comprise a high-speed filling process, a medium-speed filling process, a low-speed filling process, and a lower-speed filling process. As the filling process moves from the high-speed filling process, wherein all of the gas path control valves are open, one of the gas path control valves could be closed. Similarly, as the filling speed decelerates, the remaining open valves could be closed in sequential order, such that they are all closed at the start of the lower-speed filling process. At this point, gas escaping from the bottle would only escape through the uncontrolled gas duct 19 and the choke 22. A decelerating filling process could increase the speed of bottle filling in that a smooth, controlled, well-behaved stream of liquid could flow into the bottle without the threat of overfilling, underfilling, or the bubbling over of carbonated liquids.

The present application was described above on the basis of exemplary embodiments. It goes without saying that numerous modifications are possible without thereby going beyond the teaching on which the present application is based.

The present application relates to a filling machine that has a rotary construction for filling bottles or similar containers with a liquid, with a rotor that can be driven so that it rotates around a vertical machine axis, with a bowl provided on the rotor, the interior of which bowl forms a liquid space which is occupied by the liquid being bottled, and above that a gas headspace, with a plurality of filling elements provided on the rotor, which filling elements each have, in a filling element housing, a liquid duct with a liquid valve between a liquid connection with the liquid space and a dispensing opening provided on an underside of the housing (9), and with a return gas tube which is open at the dispensing opening and in connection with gas paths realized in the filling element housing, in each filling element there is an uncontrolled gas path with at least one choke and a first controlled gas path with at least one first gas path control valve is realized, by means of which the return gas tube can be placed in a controlled connection with the gas headspace of the bowl.

One feature or aspect of an embodiment is believed at the time of the filing of this patent application to possibly reside broadly in a beverage bottling plant for filling beverage bottles with liquid beverage material such as: soft drinks, including cola, soda, etc.; sparkling mineral water; still water; fruit juice beverages that contain preservatives; oxygen-sensitive beverages with low levels of $CO_2$, including spritzers, sports and health drinks; beverages with Vitamin C; fruit spritzers with low levels of $CO_2$; microbiologically sensitive and O2-sensitive fruit juice beverages; sports and health drinks with low levels of $CO_2$; fruit juices and fruit juice drinks; iced tea; sports and health drinks without $CO_2$; said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling elements for filling beverage bottles with liquid beverage material; at least one liquid reservoir being configured to hold a liquid to be bottled; said at least one liquid reservoir comprising a gas headspace being disposed above a liquid to be bottled within said at least one liquid reservoir; at least one supply line being configured and disposed to connect said at least one liquid reservoir to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotor being configured and disposed to carry said plurality of filling elements about its periphery; each of said filling elements comprising: a dispensing opening being configured and disposed to permit the flow of liquid through said dispensing opening and into a bottle to be filled; a liquid duct being configured and disposed to permit the flow of liquid from said liquid reservoir to said dispensing opening; a housing being configured and disposed to house said liquid duct; a return gas tube comprising an open bottom end being disposed adjacent said dispensing opening; said return gas tube being configured and disposed to permit the flow of gas from a bottle being filled with a liquid beverage; a gas chamber being configured and disposed to collect gas from said return gas tube; a valveless gas duct being connected to said gas return tube via said gas chamber and being disposed substantially parallel to said gas return tube; at least one gas path control valve being configured and disposed to be opened and closed in order to control the flow of gas from said gas return tube, to said gas headspace, during the fast-filling phase of a bottle during the filling process; at least one valved, controlled gas path being disposed between said gas chamber and said at least one gas path control valve; at least one choke being disposed in said valveless gas duct; said at least one choke having a substantially smaller cross section than the cross section of said valved, controlled gas path; said at least one choke being configured to substantially limit the flow of gas through said gas return tube at least at or near the end the filling of a bottle; a ring duct being connected to said valveless duct with said at least one choke; said ring duct being configured and disposed to carry gas from said valveless gas duct and said at least one choke at least at or near the end of filling of a bottle during slow-filling; said fast filling phase being substantially faster than said slow-filling phase.

Another feature or aspect of an embodiment is believed at the time of the filing of this patent application to possibly reside broadly in a method of dispensing liquids into a container in a container filling plant, said container filling plant comprising: a filling element for a container filling machine comprising: a dispensing opening being configured and disposed to permit the flow of liquid through said dispensing opening and into a container to be filled; a liquid duct being configured and disposed to permit the flow of liquid from said liquid reservoir to said dispensing opening; a return gas tube comprising an open bottom end being disposed adjacent said dispensing opening; said return gas tube being configured and disposed to permit the flow of gas from a container being filled with a liquid beverage; a first gas duct being operatively connected to said gas tube; at least one gas duct control valve being configured and disposed to be opened and closed in order to control the flow of gas from said gas return tube at least during the fast-filling phase of a container during the filling process; a second gas duct being operatively connected to said gas tube; said first gas duct comprising at least one orifice; said at least one orifice comprising a smaller cross section than the cross section of said second gas duct; said at least one orifice being configured to limit the flow of gas through said gas return tube at least during a slow-filling phase of filling a container; said fast filling phase being faster than said slow-filling phase; said method comprising the steps of: opening said at least one gas path control valve during the fast-filling phase during the filling of a container; removing gas from a container being filled with a liquid beverage during the filling of a container; moving gas upwards through said gas removal tube and towards said gas chamber during the filling of a container; moving gas from said gas chamber through said second gas path during the fast-filling phase during the filling of a container; moving gas through said at least one gas duct control valve during the fast-filling phase during the filling of a container; closing said at least one gas duct control valve during the slow-filling phase during the filling of a container; moving gas from said gas chamber through said first gas duct and towards said choke during the slow-filling phase during the filling of a container.

Yet another feature or aspect of an embodiment is believed at the time of the filing of this patent application to possibly reside broadly in a filling element for a container filling machine in a container filling plant comprising: a dispensing opening being configured and disposed to permit the flow of liquid through said dispensing opening and into a container to be filled; a liquid duct being configured and disposed to permit the flow of liquid from said liquid reservoir to said dispensing opening; a return gas tube comprising an open bottom end being disposed adjacent said dispensing opening; said return gas tube being configured and disposed to permit the flow of gas from a container being filled with a liquid beverage; a first gas duct being operatively connected to said gas tube; at least one gas duct control valve being configured and disposed to be opened and closed in order to control the flow of gas from said gas return tube at least during the fast-filling phase of a container during the filling process; a second gas duct being operatively connected to said gas tube; said first gas duct comprising at least one orifice; said at least one orifice comprising a smaller cross section than the cross section of said second gas duct; said at least one orifice being configured to limit the flow of gas through said gas return tube at least during a slow-filling phase of filling a container; said fast filling phase being faster than said slow-filling phase.

Yet another feature or aspect of an embodiment is believed at the time of the filing of this patent application to possibly reside broadly in a filling machine with a rotary construction for filling bottles or similar containers with a liquid, with a rotor that can be driven so that it rotates around a vertical machine axis, with a bowl provided on the rotor, the interior of which bowl forms a liquid space which is occupied by the liquid being bottled, and above that a gas headspace, with a plurality of filling elements that are provided on the rotor, which filling elements each have, in a filling element housing, a liquid duct with a liquid valve between a liquid connection with the liquid space and a dispensing opening provided on an underside of the housing, and with a return gas tube which is open at the dispensing opening and in connection with gas paths realized in the filling element housing, characterized by the fact that in each filling element, a gas path with at least one choke is realized which connects the return gas tube with a first return gas duct on the rotor side that is common to all the filling elements or for a group of filling elements, and that in each filling element a first controlled gas path with at least one first gas path control valve is realized, by means of which the return gas tube can be placed in a controlled connection with the gas headspace of the bowl.

Another feature or aspect of an embodiment is believed at the time of the filing of this patent application to possibly reside broadly in a filling machine, characterized by the fact that the return gas tube can be connected via the first controlled gas path with a rotor-side collecting duct that is common for all the filling elements or for a group of filling elements, and for its part is connected with the gas space of the bowl.

Yet another feature or aspect of an embodiment is believed at the time of the filing of this patent application to possibly reside broadly in a filling machine, characterized by the fact that associated with each filling element is a container carrier, and in particular for lifting the container to be filled against the filling element and for lowering the filled container and that a chamber is formed in the filling element housing which is in communication with the return gas tube and in which there is a piston of a lifting element that moves the container carrier toward the respective filling element.

Still another feature or aspect of an embodiment is believed at the time of the filing of this patent application to possibly reside broadly in a filling machine, characterized by a control device with which the liquid valve and the first gas path control valve for a single-chamber pressure filling can be controlled so that for a pressurization of the container that is in sealed contact with the respective filling element, the first controllable gas path is opened by the first gas path control valve for a pressurization of the container from the gas headspace of the bowl, that for a subsequent high-speed filling with the first gas path control valve still open, the liquid valve is opened, and that to end the filling process, the first gas path control valve and the liquid valve are closed.

A further feature or aspect of an embodiment is believed at the time of the filing of this patent application to possibly reside broadly in a filling machine, characterized by the fact that the first gas path control valve can be controlled by the control device such that for a low-speed filling with an open liquid valve it closes the first controlled gas path.

Another feature or aspect of an embodiment is believed at the time of the filing of this patent application to possibly reside broadly in a filling machine, characterized by the fact that in the housing of each filling element there is a second controlled gas path with at least one second gas path control valve parallel to the choke of the uncontrolled gas path.

Yet another feature or aspect of an embodiment is believed at the time of the filing of this patent application to possibly reside broadly in a filling machine, characterized by the fact that in the second, controlled gas path, at least one choke is provided in series with the second gas path control valve.

Still another feature or aspect of an embodiment is believed at the time of the filing of this patent application to possibly reside broadly in a filling machine, characterized by the fact that the second gas path control valve can be controlled by the control device such that it is closed for a pressure filling and open for a pressureless filling.

A further feature or aspect of an embodiment is believed at the time of the filing of this patent application to possibly reside broadly in a filling machine, characterized by the fact that the second gas path control valves of all the filling elements or of a group of filling elements of the filling machine can be actuated by means of a common control line.

Another feature or aspect of an embodiment is believed at the time of the filing of this patent application to possibly reside broadly in a filling machine as claimed in one of the claims 6-9, characterized by the fact that the fluid valve and the first and second gas path control valves can be controlled by the control device for a pressureless filling such that for a high-speed filling, the second and third gas path are opened, and for a low-speed filling only the third gas path is opened.

Yet another feature or aspect of an embodiment is believed at the time of the filing of this patent application to possibly reside broadly in a filling machine, characterized by the fact that the liquid valve and the first and second gas path valves can be controlled by the control device for a 3-chamber pressure filling such that for a pressurization of the individual container which is in sealed contact with the filling elements, the second gas path is opened, for a high-speed filling of the container when the liquid valve is open the third gas path is opened and the second gas path is closed, and for a subsequent low-speed filling, the second and third gas path are closed.

Still another feature or aspect of an embodiment is believed at the time of the filing of this patent application to possibly reside broadly in a filling machine, characterized by the fact that in the housing of the filling elements here is a controllable third gas path with a third gas path control valve, preferably in series with a fourth choke, and in particular parallel to the at least one choke of the second controlled gas path.

A further feature or aspect of an embodiment is believed at the time of the filing of this patent application to possibly reside broadly in a filling machine, characterized by the fact that the third gas path control valve can be controlled by the control device such that the third gas path is closed, preferably constantly closed, for a pressure filling, and opened, preferably constantly open, for a pressureless filling.

Another feature or aspect of an embodiment is believed at the time of the filing of this patent application to possibly reside broadly in a filling machine, characterized by the fact that for a volumetric filling, there is a sensor realized in the form of a flow meter in a connecting line between the respective filling element and the liquid space of the bowl.

Yet another feature or aspect of an embodiment is believed at the time of the filing of this patent application to possibly reside broadly in a filling machine, characterized by the fact that for a level-controlled filling, the filling elements each have a probe that determines the fill level.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. Patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The appended drawings in their entirety, including all dimensions, proportions and/or shapes in at least one embodiment of the invention, are accurate and are hereby included by reference into this specification.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No.

5,076,568 issued to de Jong et al. on Dec. 31, 1991; and No. 6,025 issued to Yasui on Feb. 15, 2000.

All, or substantially all, of the components and methods of the various embodiments may be used with at least one embodiment or all of the embodiments, if more than one embodiment is described herein.

An example of a liquid level sensing probe, shown in FIGS. 4 and 5, may be found in U.S. Patent Application filed by Applicant on Mar. 4, 2005, entitled "A BEVERAGE BOTTLING PLANT FOR FILLING BOTTLES WITH A LIQUID BEVERAGE MATERIAL HAVING A FILLING ELEMENT AND A FILLING MACHINE HAVING SUCH FILLING ELEMENTS," having Ser. No. 11/072,634.

Some examples of synchronous motors which may possibly be utilized or adapted for use in at least one possible embodiment may possibly be found in the following U.S. Patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

All of the patents, patent applications and publications recited herein, and in the Declaration attached hereto, are hereby incorporated by reference as if set forth in their entirety herein.

Some examples of computer systems that may possibly be utilized or possibly adapted for use in at least one possible embodiment of the present application may possibly be found in the following U.S. Patents: U.S. Pat. No. 5,416,480 issued to Roach et al. on May 16, 1995;U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S Pat. No. 5,881,227 issued to Atkinson et al. on Mar. 9, 1999; and U.S. Pat. No. 6,072,462 issued to Moshovich on Jun. 6, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of control valve apparatus that may possibly be utilized or possibly adapted for use in at least one possible embodiment of the present application may possibly be found in the following U.S. Patents: U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of electric control valves that may possibly be utilized or possibly adapted for use in at least one possible embodiment of the present application may possibly be found in the following U.S. Patents: U.S. Pat. No. 4,431,160 issued to Burt et al. on Feb. 14, 1984; and U.S. Pat. No. 4,609,176 issued to Powers on Sep. 2, 1986.

Some examples of pneumatic arrangements that may possibly be utilized or possibly adapted for use in at least one possible embodiment of the present application may possibly be found in the following U.S. Patents: U.S. Pat. No. 6,609,767 issued to Mortenson et al. on Aug. 26, 2003; U.S. Pat. No. 6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

The corresponding foreign and international patent publication applications, namely, Federal Republic of Germany Patent Application No. 10 2004 017 205.6-23, filed on Apr. 10, 2004, having inventors Ludwig Clüsserath and Dieter-Rudolf Krulitsch, and DE-OS 10 2004 017 205.6-23 and DE-PS 10 2004 017 205.6-23, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of nozzle structures that may possibly be utilized or possibly adapted for use in at least one possible embodiment of the present application may possibly be found in the following U.S. Patents: U.S. Pat. No. 6,042,026 issued to Buehler, II on Mar. 28, 2000; U.S. Pat. No. 6,394,366 issued to Adams on May 28, 2002; U.S. Pat. No. 6,402,062 issued to Bendig et al. on Jun. 11, 2002; U.S. Pat. No. 6,616,072 issued to Harata et al. on Sep. 9, 2003; U.S. Pat. No. 6,666,386 issued to Huang on Dec. 23, 2003; and U.S. Pat. No. 6,681,498 issued to Steffan on Jan. 27, 2004.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of pneumatic valves which may possibly be utilized or adapted for use in at least one possible embodiment may possibly be found in the following U.S. Patents: U.S. Pat. No. 6,772,791, entitled "Directly operated pneumatic valve having an air assist return;" U.S. Pat. No. 6,729,346, entitled "Pneumatic valve;" U.S. Pat. No. 6,676,107, entitled "Control element, especially a pneumatic valve;" U.S. Pat. No. 6,550,416, entitled "Pneumatic valve device;" U.S. Pat. No. 6,543,481, entitled "Pilot operated pneumatic valve;" U.S. Pat. No. 6,488,050, entitled "Pneumatic valve assembly;" U.S. Pat. No. 6,089,251, entitled "Pneumatic valve;" U.S. Pat. No. 4,526,341, entitled "Pneumatic shut-off valve;" U.S. Pat. No. 4,515,183, entitled "Pneumatic control valve;" and U.S. Pat. No. 4,480,663, entitled "Pneumatic relay valve."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of hydraulic valves which may possibly be utilized or adapted for use in at least one possible embodiment may possibly be found in the following U.S. Patents: U.S. Pat. No. 6,712,090, entitled "Hydraulic valve;" U.S. Pat. No. 6,745,557, entitled "Hydraulic valve arrangement;" U.S. Pat. No. 6,578,819, entitled "Hydraulic valve;" U.S. Pat. No. 6,505,645, entitled "Multiple hydraulic valve assembly with a monolithic block; U.S. Pat. No. 6,499,505, entitled "Hydraulic valve arrangement;" U.S. Pat. No. 6,427,721, entitled "Hydraulic valve arrangement with locking function;" U.S. Pat. No. 6,412,392, entitled "Hydraulic valve for a hydraulic consumer of a vehicle;" U.S. Pat. No. 6,397,891, entitled "Hydraulic valve, in particular, adjustable pressure control valve;" U.S. Pat. No. 6,349,743, entitled "High-pressure hydraulic valve;" and U.S. Pat. No. 6,305,418, entitled "Hydraulic valve."

The details in the patents, patent applications and publications may be considered to be incorporable, at applicant's option, into the claims during prosecution as further limitations in the claims to patentably distinguish any amended claims from any applied prior art.

Some examples of electric valves which may possibly be utilized or adapted for use in at least one possible embodiment may possibly be found in the following U.S. Patents: U.S. Pat. No. 5,941,502, entitled "Electric valve assembly and method of making same;" U.S. Pat. No. 5,161,776, entitled "High speed electric valve;" No. 4,770,389, entitled "Electric valve device;" U.S. Pat. No. 4,699,167, entitled "Electric valve;" U.S. Pat. No. 4,681,298, entitled "Slidable electric valve device having a spring;" U.S. Pat. No. 4,580,761, entitled "Electric valve device having a rotatable core;" and U.S. Pat. No. 4,498,491, entitled "Thermo-electric valve."

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 and having Attorney Reference No. NHL-HOL-72. The above applications are hereby incorporated by reference as if set forth in their entirety herein.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat.

No. 4,124,112, entitled "Odd-shaped container indexing starwheel;" and U.S. Pat. No. 4,084,686, entitled "Starwheel control in a system for conveying containers."

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL LIST OF TERMS

| | |
|---|---|
| 1, 1a, 1b | Filling element |
| 2 | Rotor |
| 3 | Bowl |
| 4 | Bowl interior |
| 4.1 | Gas space |
| 4.2 | Liquid space |
| 4.1.1 | Connection |
| 4.1.2 | Connection |
| 5 | Ring duct |
| 6 | Line |
| 7 | Ring duct |
| 8 | Line |
| 9 | Housing of the filling element |
| 9.1 | Housing underside |
| 10 | Liquid duct |
| 11 | Liquid valve |
| 12 | Valve body |
| 13 | Return gas tube |
| 14 | Actuator element for liquid valve |
| 15 | Dispensing opening |
| 16 | Gasket |
| 17 | Centering element |
| 18 | Chamber |
| 19, 20 | Gas duct |
| 21.1, 21.22, 21.3 | Gas path control valve |
| 22 | Choke |
| 23 | Line |
| 24 | Sensor |
| 25 | Bottle |
| 26 | Bottle carrier |
| 27 | Control roller |
| 28 | Compression spring |
| 29 | Piston |
| 30 | Gas duct |
| 31 | Choke |
| 32 | Gas duct |
| 33 | Choke |
| 34 | Rotor |
| 35 | Bowl |
| 36 | Bowl interior |
| 36.1 | Gas space |
| 36.2 | Liquid space |
| 37 | Connection |
| 38 | Probe |
| 39 | Bottle carrier |
| 39.1 | Lifting device |
| 40 | Bottle carrier |
| 41 | Control device (computer) |
| 42 | Level controller |
| 43, 44, 45 | Valve |
| N | Level |
| FA | Filling element axis |

What is claimed is:

1. A method of dispensing liquids into a container using a container filling machine, said container filling machine comprising:

a liquid reservoir being configured and disposed to hold a supply of liquid;

at least one filling element, said at least one filling element comprising:

a housing;

a dispensing opening being disposed on the bottom of said housing;

said dispensing opening being configured and disposed to permit the flow of liquid therethrough and into a container to be filled;

a liquid duct being disposed in said housing and being configured and disposed to permit the flow of liquid from said liquid passage to said dispensing opening;

a liquid valve being disposed in said liquid duct;

said liquid valve being openable and closable to control the flow of liquid to said dispensing opening and into a container;

a return gas tube being disposed in said housing and comprising an open bottom end being disposed adjacent said dispensing opening;

said return gas tube being configured and disposed to permit the flow of gas from a container being filled with a liquid;

said housing comprising a first gas passage and a second gas passage;

a first gas duct being operatively connected to said return gas tube by said first gas passage;

said first gas passage comprising an orifice;

said orifice comprising a smaller cross section than the cross section of said first gas passage to limit the flow of gas from said return gas tube to said first gas duct;

a second gas duct being operatively connected to said return gas tube by said second gas passage;

a gas duct control valve being disposed in said second gas passage; and said gas duct control valve being configured to be opened to permit flow of gas between said return gas tube and said second gas duct, and to be closed to prevent flow of gas between said return gas tube and said second gas duct;

a control device being operatively connected to said gas duct control valve and said liquid valve to control the opening and closing thereof;

said method comprising the steps of:

filling a first run of containers under pressure at a first filling rate;

filling a second run of containers under pressure at a second filling rate, said second filling rate being slower than said first filling rate;

said step of filling a first run of containers under pressure at a first filling rate comprising the steps of:

opening said gas duct control valve and moving gas through said second gas duct, said second gas passage, and said gas return tube and into a container to pressurize the container;

opening said liquid valve and dispensing liquid into the container, and substantially simultaneously removing the gas from the container by moving the gas through said gas return tube, said first and second gas passages, and said first and second gas ducts; and filling the container to a desired level of liquid and then closing said liquid valve and said gas duct control valve; and said step of filling a second run of containers under pressure at a second filling rate comprising the steps of:

opening said gas duct control valve and moving gas through said second gas duct, said second passage, and said gas return tube and into a container to pressurize the container;

opening said liquid valve and dispensing liquid into the container, and substantially simultaneously closing said gas duct control valve and removing the gas from the container by moving the gas through said gas return tube, said first gas passage, and said first gas duct; and filling the container to a desired level of liquid and then closing said liquid valve.

2. The method according to claim 1, wherein:

said first gas ducts of at least a portion of said filling elements are connected to form a common first gas duct;

said second gas ducts of at least a portion of said filling elements are connected to form a common second gas duct;

each filling element comprises a container carrier configured and disposed to lift a container to be filled into engagement with said dispensing opening and to lower a filled container out of engagement with said dispensing opening;

said housing comprises a chamber configured and disposed to permit the flow of gas therethrough between said return gas tube and said first and second gas ducts;

each filling element comprises a piston disposed in said chamber and operatively connected to said container carrier to lift said container carrier toward its filling element upon said chamber being pressurized; and said method further comprises the steps of:

lifting a container with said container carrier into engagement with said dispensing opening to permit filling of the container;

pressurizing said chamber and moving said piston to further lift a container in said container carrier into engagement with said dispensing opening; and lowering a container with said container carrier out of engagement with said dispensing opening upon completion of filling of the container.

3. The method according to claim 2, wherein:

said housing comprises a third gas passage;

said third gas passage comprises a second orifice;

said second orifice comprises a smaller cross section than the cross section of said third gas passage to limit the flow of gas therethrough;

said filling element comprises a second gas duct control valve disposed in said third gas passage to control the flow of gas therethrough;

said second gas duct control valve and said second orifice are disposed in series;

said control device is configured to close said second gas duct control valve for a pressure filling and to open said second gas duct control valve for a pressureless filling;

said second gas duct control valves of all said filling elements or of a portion of said filling elements are actuatable by a common control line;

said step of filling a first run of containers under pressure at a first filling rate further comprises closing said second gas duct control valve; and said step of filling a second run of containers under pressure at a second filling rate further comprises closing said second gas duct control valve.

4. The method according to claim 3, wherein:

said control device is configured to open said first gas duct control valve and said second gas duct control valve to open said second and third gas passages for pressureless filling of containers at a third filling rate; and said control device is configured to close said first gas duct control valve to close said second gas passage, and to open said second gas duct control valve to open said third gas passage for pressureless filling of containers at a fourth filling rate, wherein said fourth filling rate is slower than said third filling rate;

said method further comprises the steps of:

filling a third run of containers without pressure at a third filling rate;

filling a fourth run of containers without pressure at a fourth filling rate;

said step of filling a third run of containers without pressure at a third filling rate comprises the steps of:

opening said first gas duct control valve and said second gas duct control valve;

opening said liquid valve and dispensing liquid into the container, and substantially simultaneously removing gas from the container by moving gas through said gas return tube, said first, second, and third gas passages, and said first and second gas ducts; and filling the container to a desired level of liquid and then closing said liquid valve and said first gas duct control valve; and said step of filling a fourth run of containers without pressure at a fourth filling rate comprises the steps of:

opening said second gas duct control valve;

opening said liquid valve and dispensing liquid into the container, and substantially simultaneously removing gas from the container by moving gas through said gas return tube, said first and third gas passages, and said first gas duct; and filling the container to a desired level of liquid and then closing said liquid valve.

5. The method according to claim 4, wherein said control device is configured to control said liquid valve and said first and second gas duct control valves in a 3-chamber pressure filling, wherein:

said control device is configured to open said first gas duct control valve to pressurize a container to be filled under pressure and then to close said first gas duct control valve;

said control device is configured to open said liquid valve and said second gas duct control valve for filling of the container at a fifth filling rate;

said control device is configured to open said liquid valve and close said second gas duct control valve for filling of the container at a sixth filling rate, wherein said sixth filling rate is slower than said fifth filling rate;

said method further comprises the steps of:

filling a fifth run of containers under pressure at a fifth filling rate;

filling a sixth run of containers under pressure at a sixth filling rate;

said step of filling a fifth run of containers under pressure at a fifth filling rate comprising the steps of:

opening said first gas duct control valve and moving gas through said second gas duct, said second gas passage, and said gas return tube and into a container to pressurize the container, and then closing said first gas duct control valve;

opening said second gas duct control valve and said liquid valve and dispensing liquid into the container, and substantially simultaneously removing the gas from the container by moving the gas through said gas return tube, said first and third gas passages, and said first gas duct; and filling the container to a desired level of liquid and then closing said liquid valve; and said step of filling a sixth run of containers under pressure at a sixth filling rate comprising the steps of:

opening said first gas duct control valve and moving gas through said second gas duct, said second gas passage, and said gas return tube and into a container to pressurize the container, and then closing said first gas duct control valve;

closing said second gas duct control valve and opening said liquid valve and dispensing liquid into the container, and substantially simultaneously removing the gas from the container by moving the gas through said gas return tube, said first gas passage, and said first gas duct; and filling the container to a desired level of liquid and then closing said liquid valve.

6. The method according to claim 5, wherein:

said housing comprises a fourth gas passage;

said fourth gas passage comprises a third orifice;

said third orifice comprises a smaller cross section than the cross section of said fourth gas passage to limit the flow of gas therethrough;

said filling element comprises a third gas duct control valve disposed in said fourth gas passage to control the flow of gas therethrough;

said third gas duct control valve and said third orifice are disposed in series; and said control device is configured to close said third gas duct control valve for a pressure filling and to open said third gas duct control valve for a pressureless filling; and said method further comprises the steps of closing said third gas duct control valve for a pressure filling and opening said third gas duct control valve for a pressureless filling.

7. The method according to claim 6, wherein:

each of said filling elements comprises a sensor for a volumetric filling;

said sensor comprises a flow meter disposed at or in said liquid passage; and each of said filling elements comprises a probe that determines the fill level.

8. A container filling machine for filling containers with a liquid, said container filling machine comprising:

a liquid reservoir being configured and disposed to hold a supply of liquid;

at least one filling element, said at least one filling element comprising:

a housing;

a dispensing opening being disposed on the bottom of said housing;

said dispensing opening being configured and disposed to permit the flow of liquid therethrough and into a container to be filled;

a liquid duct being disposed in said housing and being configured and disposed to permit the flow of liquid from said liquid reservoir to said dispensing opening;

a return gas tube being disposed in said housing and comprising an open bottom end being disposed adjacent said dispensing opening;

said return gas tube being configured and disposed to permit the flow of gas from a container being filled with a liquid;

said housing comprising a first gas passage and a second gas passage;

a first gas duct being operatively connected to said return gas tube by said first gas passage;

said first gas passage comprising an orifice;

said orifice comprising a smaller cross section than the cross section of said first gas passage to limit the flow of gas from said return gas tube to said first gas duct;

a second gas duct being operatively connected to said return gas tube by said second gas passage;

a gas duct control valve being disposed in said second gas passage; and said gas duct control valve being configured to be opened to permit flow of gas between said return gas tube and said second gas duct, and to be closed to prevent flow of gas between said return gas tube and said second gas duct;

a control device being operatively connected to said gas duct control valve to control the opening and closing thereof; and said control device being configured to open said gas duct control valve to permit gas flowing out of a container being filled with liquid at a first filling rate to flow into said second gas duct, and being configured to close said gas duct control valve to prevent gas flowing out of a container being filled with liquid at a second filling rate from flowing into said second gas duct, wherein said second filling rate is slower than said first filling rate.

9. The container filling machine according to claim 8, wherein:

said at least one filling element comprises a plurality of filling elements;

said first gas ducts of at least a portion of said filling elements are connected to form a common first gas duct;

said second gas ducts of at least a portion of said filling elements are connected to form a common second gas duct;

each filling element comprises a container carrier configured and disposed to lift a container to be filled into engagement with said dispensing opening and to lower a filled container out of engagement with said dispensing opening;

said housing comprises a chamber configured and disposed to permit the flow of gas therethrough between said return gas tube and said first and second gas ducts; and each filling element comprises a piston disposed in said chamber and operatively connected to said container carrier to lift said container carrier toward its filling element upon said chamber being pressurized.

10. The container filling machine according to claim 9, wherein:

said control device is configured to open said gas duct control valve to permit gas to flow from said second gas duct, through said second gas passage and said return gas tube, and into a container to pressurize the container in a pressure filling;

said control device is configured to open said liquid valve to permit liquid to flow into a container to be filled;

said control device is configured to keep said gas duct control valve open to permit gas flowing out of a container being filled under pressure with liquid at a first filling rate to flow into said second gas duct and into said upper portion of said liquid reservoir, and to close both said liquid valve and said gas duct control valve upon completion of filling the container to a desired level at said first filling rate; and said control device is configured to close said gas duct control valve to prevent gas flowing out of a container being filled under pressure with liquid at a second filling rate from flowing into said second gas duct, and to close said liquid valve upon completion of filling the container to a desired level at said second filling rate.

11. The container filling machine according to claim 10, wherein:

said housing comprises a third gas passage;

said third gas passage comprises a second orifice;

said second orifice comprises a smaller cross section than the cross section of said third gas passage to limit the flow of gas therethrough;

said filling element comprises a second gas duct control valve disposed in said third gas passage to control the flow of gas therethrough;

said second gas duct control valve and said second orifice are disposed in series;

said control device is configured to close said second gas duct control valve for a pressure filling and to open said second gas duct control valve for a pressureless filling;

said second gas duct control valves of all said filling elements or of a portion of said filling elements are actuatable by a common control line;

said control device is configured to open said first gas duct control valve and said second gas duct control valve to open said second and third gas passages for pressureless filling of containers at a third filling rate;

said control device is configured to close said first gas duct control valve to close said second gas passage, and to open said second gas duct control valve to open said third gas passage for pressureless filling of containers at a fourth filling rate, wherein said fourth filling rate is slower than said third filling rate;

said control device is configured to control said liquid valve and said first and second gas duct control valves in a 3-chamber pressure filling, wherein:

said control device is configured to open said first gas duct control valve to pressurize a container to be filled under pressure and then to close said first gas duct control valve;

said control device is configured to open said liquid valve and said second gas duct control valve for filling of the container at a fifth filling rate; and said control device is configured to open said liquid valve and close said second gas duct control valve for filling of the container at a sixth filling rate, wherein said sixth filling rate is slower than said fifth filling rate.

12. The container filling machine according to claim 11, wherein:

said housing comprises a fourth gas passage;

said fourth gas passage comprises a third orifice;

said third orifice comprises a smaller cross section than the cross section of said fourth gas passage to limit the flow of gas therethrough;

said filling element comprises a third gas duct control valve disposed in said fourth gas passage to control the flow of gas therethrough;

said third gas duct control valve and said third orifice are disposed in series;

said control device is configured to close said third gas duct control valve for a pressure filling and to open said third gas duct control valve for a pressureless filling;

each of said filling elements comprises a sensor for a volumetric filling;

said sensor comprises a flow meter disposed at or in said liquid passage; and each of said filling elements comprises a probe that determines the fill level.

13. A rotary container filling machine for filling containers, such as bottles, with a liquid, said container filling machine comprising:

a rotor being configured and disposed to rotate around a vertical axis;

a substantially circular, ring-shaped liquid reservoir being disposed on said rotor;

said liquid reservoir being configured to hold a supply of liquid in a lower portion thereof, and being configured to hold a supply of gas in an upper portion thereof;

a plurality of filling elements being disposed about the periphery of said rotor;

each of said filling elements comprising:

a housing;

a liquid passage being connected to said liquid reservoir and being configured to permit the flow of liquid therethrough from said lower portion of said liquid reservoir into said housing;

a dispensing opening being disposed on the bottom of said housing;

said dispensing opening being configured and disposed to permit the flow of liquid therethrough and into a container to be filled;

a liquid duct being disposed in said housing and being configured and disposed to permit the flow of liquid from said liquid passage to said dispensing opening;

a liquid valve being disposed in said liquid duct;

said liquid valve being openable and closable to control the flow of liquid to said dispensing opening and into a container;

a return gas tube being disposed in said housing and comprising an open bottom end being disposed adjacent said dispensing opening;

said return gas tube being configured and disposed to permit the flow of gas from a container being filled with a liquid;

said housing comprising a first gas passage and a second gas passage;

a first gas duct being operatively connected to said return gas tube by said first gas passage;

said first gas passage comprising an orifice;

said orifice comprising a smaller cross section than the cross section of said first gas passage to limit the flow of gas from said return gas tube to said first gas duct;

a second gas duct being operatively connected to said return gas tube by said second gas passage, and being connected to said upper portion of said liquid reservoir;

a gas duct control valve being disposed in said second gas passage; and said gas duct control valve being configured to be opened to permit flow of gas between said return gas tube and said upper portion of said liquid reservoir, and to be closed to prevent flow of gas between said return gas tube and said upper portion of said liquid reservoir.

14. The container filling machine according to claim 13, wherein:

said first gas ducts of at least a portion of said filling elements are connected to form a common first gas duct;

said second gas ducts of at least a portion of said filling elements are connected to form a common second gas duct;

each filling element comprises a container carrier configured and disposed to lift a container to be filled into engagement with said dispensing opening and to lower a filled container out of engagement with said dispensing opening;

said housing comprises a chamber configured and disposed to permit the flow of gas therethrough between said return gas tube and said first and second gas ducts; and each filling element comprises a piston disposed in said chamber and operatively connected to said container carrier to lift said container carrier toward its filling element upon said chamber being pressurized.

15. The container filling machine according to claim 14, wherein said container filling machine further comprises:

a control device operatively connected to said gas duct control valve and said liquid valve to control the opening and closing thereof;

said control device is configured to open said gas duct control valve to permit gas to flow from said second gas duct, through said second gas passage and said return gas tube, and into a container to pressurize the container in a pressure filling;

said control device is configured to open said liquid valve to permit liquid to flow into a container to be filled;

said control device is configured to keep said gas duct control valve open to permit gas flowing out of a container being filled under pressure with liquid at a first filling rate to flow into said second gas duct and into said upper portion of said liquid reservoir, and to close both said liquid valve and said gas duct control valve upon completion of filling the container to a desired level at said first filling rate; and said control device is configured to close said gas duct control valve to prevent gas flowing out of a container being filled under pressure with liquid at a second filling rate from flowing into said second gas duct, and to close said liquid valve upon completion of filling the container to a desired level at said second filling rate, which said second filling rate is slower than said first filling rate.

16. The container filling machine according to claim 15, wherein:

said housing comprises a third gas passage;

said third gas passage comprises a second orifice;

said second orifice comprises a smaller cross section than the cross section of said third gas passage to limit the flow of gas therethrough;

said filling element comprises a second gas duct control valve disposed in said third gas passage to control the flow of gas therethrough; and said second gas duct control valve and said second orifice are disposed in series.

17. The container filling machine according to claim 16, wherein:

said control device is configured to close said second gas duct control valve for a pressure filling and to open said second gas duct control valve for a pressureless filling;

said second gas duct control valves of all said filling elements or of a portion of said filling elements are actuatable by a common control line;

said control device is configured to open said first gas duct control valve and said second gas duct control valve to open said second and third gas passages for pressureless filling of containers at a third filling rate; and said control device is configured to close said first gas duct control valve to close said second gas passage, and to open said second gas duct control valve to open said third gas passage for pressureless filling of containers at a fourth filling rate, wherein said fourth filling rate is slower than said third filling rate.

18. The container filling machine according to claim 17, wherein said control device is configured to control said liquid valve and said first and second gas duct control valves in a 3-chamber pressure filling, wherein:

said control device is configured to open said first gas duct control valve to pressurize a container to be filled under pressure and then to close said first gas duct control valve;

said control device is configured to open said liquid valve and said second gas duct control valve for filling of the container at a fifth filling rate; and said control device is configured to open said liquid valve and close said second gas duct control valve for filling of the container at a sixth filling rate, wherein said sixth filling rate is slower than said fifth filling rate.

19. The container filling machine according to claim 18, wherein:

said housing comprises a fourth gas passage;

said fourth gas passage comprises a third orifice;

said third orifice comprises a smaller cross section than the cross section of said fourth gas passage to limit the flow of gas therethrough;

said filling element comprises a third gas duct control valve disposed in said fourth gas passage to control the flow of gas therethrough; and said third gas duct control valve and said third orifice are disposed in series.

20. The container filling machine according to claim 19, wherein:

said control device is configured to close said third gas duct control valve for a pressure filling and to open said third gas duct control valve for a pressureless filling;

each of said filling elements comprises a sensor for a volumetric filling;

said sensor comprises a flow meter disposed at or in said liquid passage; and each of said filling elements comprises a probe that determines the fill level.

* * * * *